US008479504B2

(12) United States Patent
Kerckhove et al.

(10) Patent No.: US 8,479,504 B2
(45) Date of Patent: Jul. 9, 2013

(54) HYDRAULIC SYSTEM HAVING AN EXTERNAL PRESSURE COMPENSATOR

(75) Inventors: Philippe Vande Kerckhove, Overijse (BE); James A. Aardema, Plymouth, MN (US); Pengfei Ma, Naperville, IL (US); Kalpesh Patel, Romeoville, IL (US)

(73) Assignee: Caterpillar Inc., Peoria, IL (US)

( * ) Notice: Subject to any disclaimer, the term of this patent is extended or adjusted under 35 U.S.C. 154(b) by 916 days.

(21) Appl. No.: 12/605,465

(22) Filed: Oct. 26, 2009

(65) Prior Publication Data

US 2010/0107623 A1 May 6, 2010

Related U.S. Application Data

(63) Continuation-in-part of application No. 11/806,383, filed on May 31, 2007, now abandoned.

(51) Int. Cl.
*F15B 11/05* (2006.01)
*F15B 11/044* (2006.01)

(52) U.S. Cl.
USPC ..... 60/452; 91/446; 91/454

(58) Field of Classification Search
USPC ..... 60/452; 91/446, 454
See application file for complete search history.

(56) References Cited

U.S. PATENT DOCUMENTS

| | | | |
|---|---|---|---|
| 3,366,202 | A | 1/1968 | James |
| 4,046,270 | A | 9/1977 | Baron et al. |
| 4,222,409 | A | 9/1980 | Budzich |
| 4,250,794 | A | 2/1981 | Haak et al. |
| 4,316,486 | A | 2/1982 | Tandrup et al. |
| 4,416,187 | A | 11/1983 | Nystrom |
| 4,437,385 | A | 3/1984 | Kramer et al. |
| 4,480,527 | A | 11/1984 | Lonnemo |

(Continued)

FOREIGN PATENT DOCUMENTS

| | | |
|---|---|---|
| DE | 19646428 | 5/1998 |
| DE | 19855187 | 5/2000 |

(Continued)

OTHER PUBLICATIONS

Muller, U.S. Appl. No. 11/453,904; EH Poppett Valve Having Force Feedback, filed Jun. 16, 2006.

(Continued)

*Primary Examiner* — Thomas E Lazo
(74) *Attorney, Agent, or Firm* — Jonathan V. Trousdale; Finnegan, Henderson, Farabow, Garrett & Dunner LLP

(57) ABSTRACT

A hydraulic system for a machine is disclosed. The hydraulic system has a source of pressurized fluid and a fluid actuator with a first chamber. The hydraulic system also has a first valve configured to selectively fluidly communicate the source with the first chamber. The first valve further includes a first element movable between a flow passing, at which fluid from the source flows to the first chamber, and a flow blocking position, at which fluid from the source is blocked from the first chamber and a second element configured to selectively drain a control passageway associated with the first element to cause the first element to move. The hydraulic system further has a proportional pressure compensating valve configured to control a pressure of a fluid directed between the source and the first valve dependent upon the pressure of the control passageway.

20 Claims, 2 Drawing Sheets

U.S. PATENT DOCUMENTS

| | | | |
|---|---|---|---|
| 4,581,893 | A | 4/1986 | Lindbom |
| 4,586,330 | A | 5/1986 | Watnabe et al. |
| 4,623,118 | A | 11/1986 | Kumar |
| 4,662,601 | A | 5/1987 | Andersson |
| 4,706,932 | A | 11/1987 | Yoshida et al. |
| 4,711,267 | A | 12/1987 | Schweim |
| 4,747,335 | A | 5/1988 | Budzich |
| 4,799,420 | A | 1/1989 | Budzich |
| 4,835,966 | A | 6/1989 | Kauss et al. |
| 5,137,254 | A | 8/1992 | Aardema et al. |
| 5,152,142 | A | 10/1992 | Budzich |
| 5,211,196 | A | 5/1993 | Schwelm |
| 5,287,794 | A | 2/1994 | Andersson |
| 5,297,381 | A | 3/1994 | Eich et al. |
| 5,313,873 | A | 5/1994 | Gall et al. |
| 5,350,152 | A | 9/1994 | Hutchison et al. |
| 5,366,202 | A | 11/1994 | Lunzman |
| 5,447,093 | A | 9/1995 | Budzich |
| 5,477,677 | A | 12/1995 | Krnavek |
| 5,537,818 | A | 7/1996 | Hosseini et al. |
| 5,553,452 | A | 9/1996 | Snow et al. |
| 5,568,759 | A | 10/1996 | Aardema |
| 5,678,470 | A | 10/1997 | Koehler |
| 5,701,933 | A | 12/1997 | Lunzman |
| 5,813,226 | A | 9/1998 | Krone |
| 5,813,309 | A | 9/1998 | Taka et al. |
| 5,857,330 | A | 1/1999 | Ishizaki et al. |
| 5,868,059 | A | 2/1999 | Smith |
| 5,878,647 | A | 3/1999 | Wilke et al. |
| 5,890,362 | A | 4/1999 | Wilke |
| 5,947,140 | A | 9/1999 | Aardema et al. |
| 5,960,695 | A | 10/1999 | Aardema et al. |
| 6,009,708 | A | 1/2000 | Miki et al. |
| 6,026,730 | A | 2/2000 | Yoshida et al. |
| 6,082,106 | A | 7/2000 | Hamamoto |
| 6,216,456 | B1 | 4/2001 | Mitchell |
| 6,367,365 | B1 | 4/2002 | Weickert et al. |
| 6,397,655 | B1 | 6/2002 | Stephenson |
| 6,467,264 | B1 | 10/2002 | Stephenson et al. |
| 6,502,393 | B1 | 1/2003 | Stephenson et al. |
| 6,502,500 | B2 | 1/2003 | Yoshino |
| 6,516,614 | B1 * | 2/2003 | Knoll ..... 60/452 |
| 6,598,391 | B2 | 7/2003 | Lunzman et al. |
| 6,619,183 | B2 | 9/2003 | Yoshino |
| 6,655,136 | B2 | 12/2003 | Holt et al. |
| 6,662,705 | B2 | 12/2003 | Huang et al. |
| 6,691,603 | B2 | 2/2004 | Linerode et al. |
| 6,694,860 | B2 | 2/2004 | Yoshino |
| 6,715,402 | B2 | 4/2004 | Pfaff et al. |
| 6,718,759 | B1 | 4/2004 | Tabor |
| 6,725,131 | B2 | 4/2004 | Lunzman |
| 6,732,512 | B2 | 5/2004 | Pfaff et al. |
| 6,748,738 | B2 | 6/2004 | Smith |
| 6,761,029 | B2 | 7/2004 | Linerode |
| 7,204,185 | B2 | 4/2007 | Ma et al. |
| 7,240,604 | B2 | 7/2007 | Smith et al. |
| 2003/0121256 | A1 | 7/2003 | Mather |
| 2003/0121409 | A1 | 7/2003 | Lunzman et al. |
| 2003/0125840 | A1 | 7/2003 | Lunzman et al. |
| 2003/0196545 | A1 | 10/2003 | Jensen et al. |
| 2004/0055288 | A1 | 3/2004 | Pfaff et al. |
| 2004/0055289 | A1 | 3/2004 | Pfaff et al. |
| 2004/0055452 | A1 | 3/2004 | Tabor |
| 2004/0055453 | A1 | 3/2004 | Tabor |
| 2004/0055454 | A1 | 3/2004 | Pfaff et al. |
| 2004/0055455 | A1 | 3/2004 | Tabor et al. |
| 2006/0090460 | A1 | 5/2006 | Ma et al. |
| 2006/0243128 | A1 | 11/2006 | Ma et al. |
| 2006/0243129 | A1 | 11/2006 | Ma et al. |

FOREIGN PATENT DOCUMENTS

| | | |
|---|---|---|
| EP | 0468944 | 1/1992 |
| EP | 1338802 | 8/2003 |
| JP | 02613041 | 5/1997 |

OTHER PUBLICATIONS

Ma, U.S. Appl. No. 11/454,500; Bidirectional Force Feedback Poppet Valve, filed Jun. 16, 2006.

* cited by examiner

HYDRAULIC SYSTEM HAVING AN EXTERNAL PRESSURE COMPENSATOR

RELATED APPLICATIONS

This patent application is a continuation-in-part of U.S. patent application Ser. No. 11/806,383, filed May 31, 2007, which is hereby incorporated by reference.

TECHNICAL FIELD

The present disclosure relates generally to a hydraulic system, and more particularly, to a hydraulic system having an external pressure compensator.

BACKGROUND

Machines such as, for example, dozers, loaders, excavators, motor graders, and other types of heavy machinery use one or more hydraulic actuators to accomplish a variety of tasks. These actuators are fluidly connected to a pump on the machine that provides pressurized fluid to chambers within the actuators. An electro-hydraulic valve arrangement is typically fluidly connected between the pump and the actuators to control a flow rate and direction of pressurized fluid to and from the chambers of the actuators.

Machine hydraulic circuits that fluidly connect multiple actuators to a common pump experience undesirable pressure fluctuations within the circuits during operation of the actuators. In particular, the pressure of a fluid supplied to one actuator can undesirably fluctuate in response to operation of a different actuator fluidly connected to the same hydraulic circuit. These pressure fluctuations may cause inconsistent and/or unexpected actuator movements. In addition, the pressure fluctuations can be severe enough and/or occur often enough to cause malfunction or premature failure of hydraulic circuit components.

One method of reducing these pressure fluctuations within the fluid supplied to a hydraulic actuator is described in U.S. Pat. No. 5,878,647 (the '647 patent) issued to Wilke et al. on Mar. 9, 1999. The '647 patent describes a hydraulic circuit having two pairs of solenoid valves, a variable displacement pump, a reservoir tank, and a hydraulic actuator. One pair of the solenoid valves includes a head-end supply valve and a head-end return valve that connects a head end of the hydraulic actuator to either the variable displacement pump or the reservoir tank. The other pair of solenoid valves includes a rod-end supply valve and a rod-end return valve that connects a rod end of the hydraulic actuator to either the variable displacement pump or the reservoir tank. Each of these four solenoid valves is associated with a different pressure compensating check valve. Each pressure compensating check valve is connected between the associated solenoid valve and the actuator to control a pressure of the fluid between the associated valve and the actuator.

Although the multiple pressure compensating valves of the hydraulic circuit described in the '647 patent may reduce pressure fluctuations within the hydraulic circuit, they may also increase the cost and complexity of the hydraulic circuit. In addition, the pressure compensating valves of the '647 patent may not control the pressures within the hydraulic circuit precisely enough for optimal performance of the associated actuator.

The disclosed hydraulic system is directed to overcoming one or more of the problems set forth above.

SUMMARY OF THE INVENTION

In one aspect, the present disclosure is directed to a hydraulic system. The hydraulic system includes a source of pressurized fluid, a tank and a fluid actuator having a first chamber. The hydraulic system also includes a first valve configured to selectively fluidly communicate the source with the first chamber. The first valve includes a first valve element movable between a flow passing position, at which fluid from the source flows to the first chamber, and a flow blocking position, at which fluid from the source is blocked from the first chamber. The first valve further includes a second element configured to selectively drain a first control passageway associated with the first valve element to cause the first valve element to move. The hydraulic system further includes a proportional pressure compensating valve located to control a pressure of a fluid directed between the source and the first valve.

In another aspect, the present disclosure is directed to a method of operating a hydraulic system. The method includes pressurizing a fluid and directing the pressurized fluid to a first chamber of an actuator via a first valve. The method also includes selectively operating the first valve to move the actuator. The method further includes moving a proportional pressure compensating valve element in response to pressures at a control passageway of the first valve to maintain a pressure differential across the first valve within a predetermined range of a desired pressure differential.

DETAILED DESCRIPTION

Figure 1:
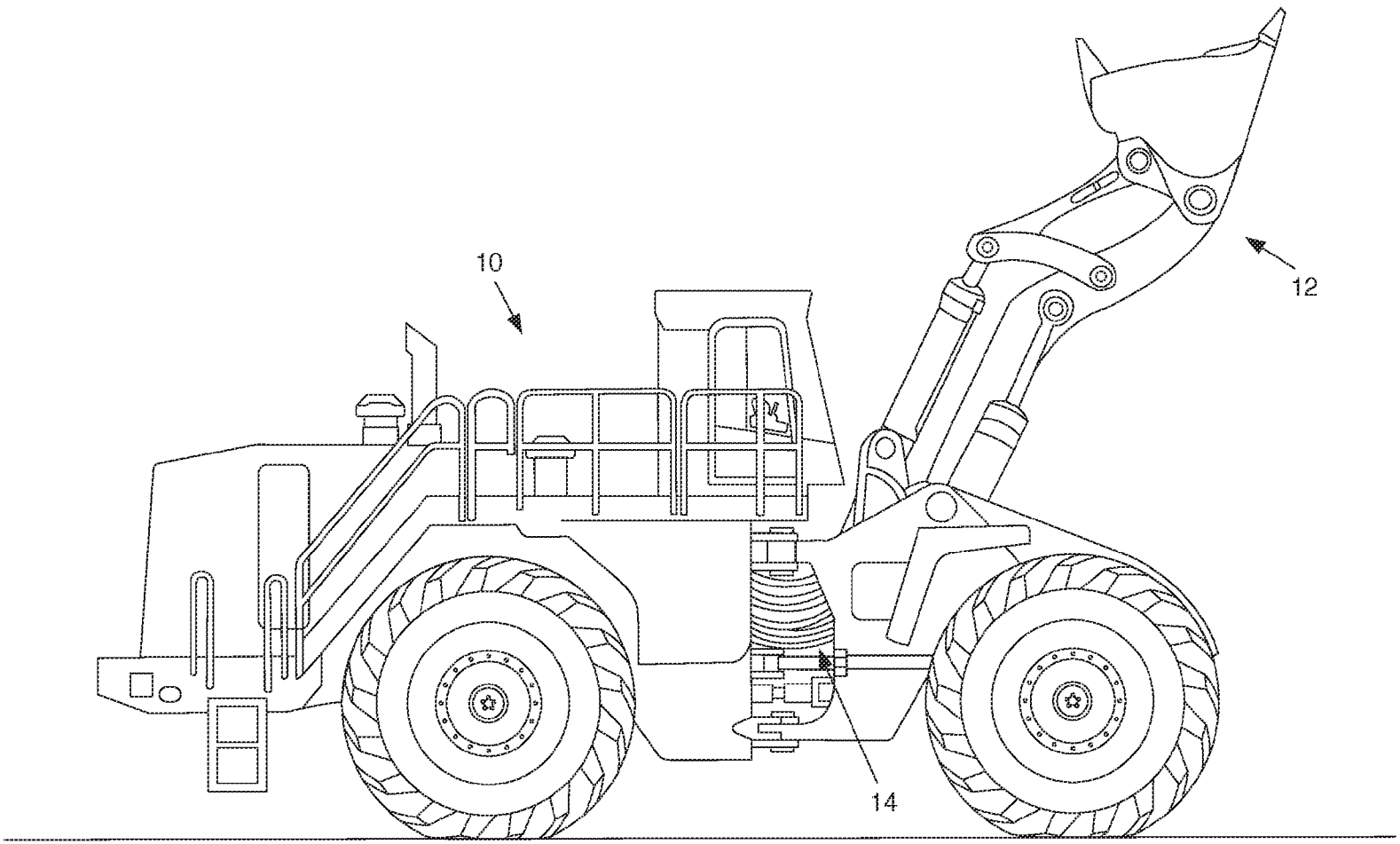
FIG. 1 is a side-view diagrammatic illustration of a machine according to an exemplary disclosed embodiment.

FIG. 1 illustrates an exemplary machine 10. Machine 10 may be a fixed or mobile machine that performs some type of operation associated with an industry such as mining, construction, farming, or any other industry known in the art. For example, machine 10 may be an earth moving machine such as a dozer, a loader, a backhoe, an excavator, a motor grader, a dump truck, or any other earth moving machine. Machine 10 may also embody a generator set, a pump, a marine vessel, or any other suitable operation-performing machine. Machine 10 may include a frame 12, at least one work implement 14, and a hydraulic actuator 16 connecting work implement 14 to frame 12.

Frame 12 may include any structural unit that supports movement of machine 10. Frame 12 may be, for example, a stationary base frame connecting a power source (not shown) of machine 10 to a fraction device 18, a movable frame member of a linkage system, or any other frame known in the art.

Work implement 14 may include any device used in the performance of a task. For example, work implement 14 may include a blade, a bucket, a shovel, a ripper, a dump bed, a propelling device, or any other task-performing device known in the art. Work implement 14 may be connected to frame 12 via a direct pivot 20, via a linkage system with hydraulic cylinder 16 forming one member in the linkage system, or in any other appropriate manner. Work implement 14 may pivot, rotate, slide, swing, or move relative to frame 12 in any other manner known in the art.

Figure 2:
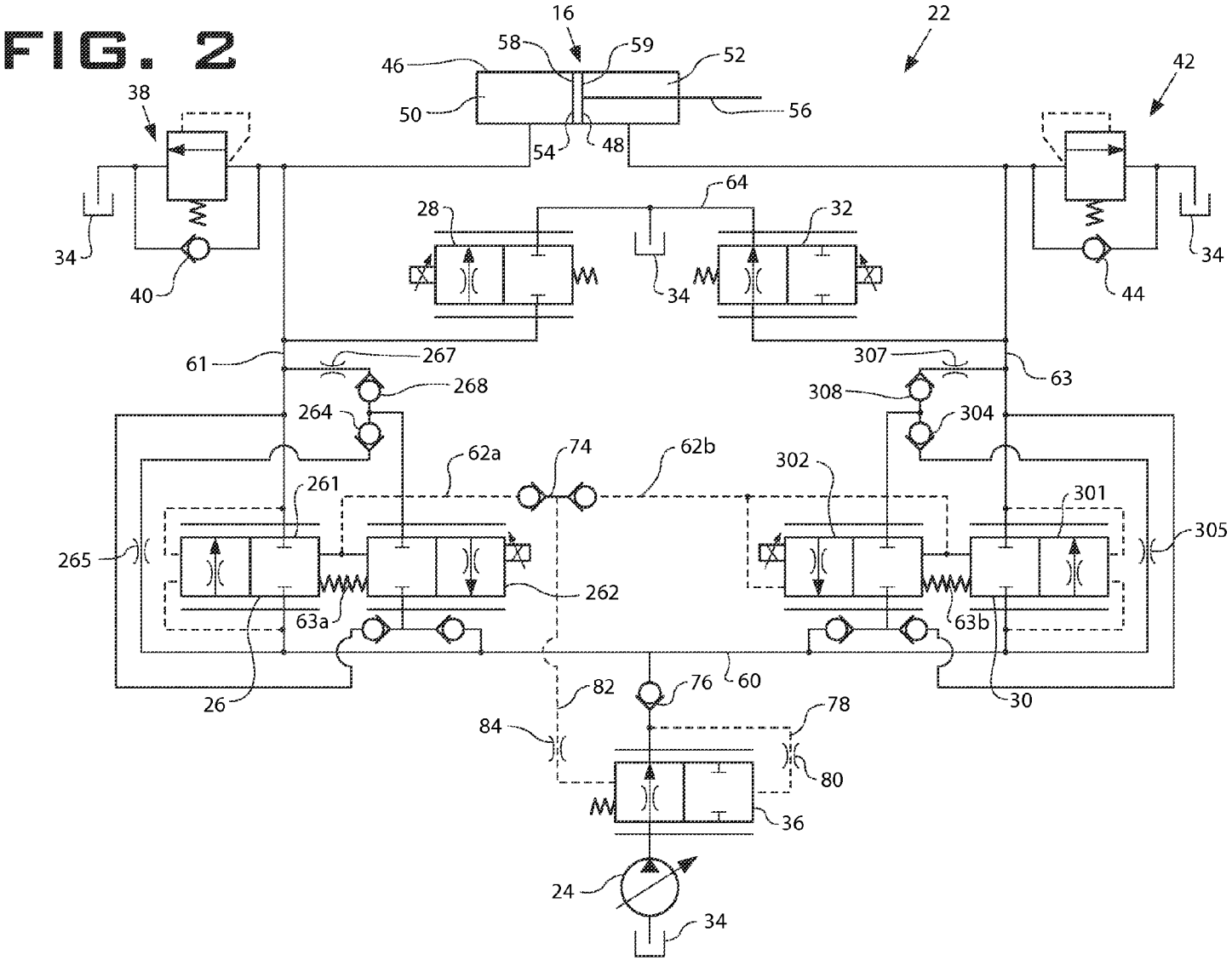
FIG. 2 is a schematic illustration of an exemplary disclosed hydraulic circuit.

As illustrated in FIG. 2, hydraulic actuator 16 may be one of various components within a hydraulic system 22 that cooperate to move work implement 14. Some of the other components of hydraulic system 22 may include a source 24 of pressurized fluid, a tank 34, a head-end supply valve 26, a head-end drain valve 28, a rod-end supply valve 30, and a rod-end drain valve 32.

Although, in the disclosed embodiment, hydraulic actuator 16 may embody a cylinder having a tube 46 and a piston assembly 48 disposed within tube 46, hydraulic actuator 16 could just as easily embody a rotary motor. One of tube 46 and piston assembly 48 may be pivotally connected to frame 12, while the other of tube 46 and piston assembly 48 may be pivotally connected to work implement 14. It is contemplated that tube 46 and/or piston assembly 48 may alternately be fixedly connected to either frame 12 or work implement 14. Hydraulic actuator 16 may include a first chamber 50 and a second chamber 52 separated by piston assembly 48. The first and second chambers 50, 52 may be selectively supplied with a fluid pressurized by source 24 and fluidly connected with tank 34 to cause piston assembly 48 to displace within tube 46, thereby changing the effective length of hydraulic actuator 16. The expansion and retraction of hydraulic actuator 16 may assist in moving work implement 14.

Piston assembly 48 may include a piston 54 axially aligned with and disposed within tube 46, and a piston rod 56 connectable to one of frame 12 and work implement 14 (referring to FIG. 1). Piston 54 may include a first hydraulic surface 58 and a second hydraulic surface 59 opposite first hydraulic surface 58. An imbalance of force caused by fluid pressure on first and second hydraulic surfaces 58, 59 may result in movement of piston assembly 48 within tube 46. For example, a force on first hydraulic surface 58 being greater than a force on second hydraulic surface 59 may cause piston assembly 48 to displace to increase the effective length of hydraulic actuator 16. Similarly, when a force on second hydraulic surface 59 is greater than a force on first hydraulic surface 58, piston assembly 48 may retract within tube 46 to decrease the effective length of hydraulic actuator 16. A sealing member (not shown), such as an o-ring, may be connected to piston 54 to restrict a flow of fluid between an internal wall of tube 46 and an outer cylindrical surface of piston 54.

Source 24 may produce a flow of pressurized fluid and include a pump such as, for example, a variable displacement pump, a fixed displacement pump, or any other source of pressurized fluid known in the art. Source 24 may be drivably connected to the power source (not shown) of machine 10 by, for example, a countershaft (not shown), a belt (not shown), an electrical circuit (not shown), or in any other suitable manner. Source 24 may be dedicated to supplying pressurized fluid only to hydraulic system 22 or, alternatively, may supply pressurized fluid to additional hydraulic systems (not shown) within machine 10.

Tank 34 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 34. It is also contemplated that hydraulic system 22 may be connected to multiple separate fluid tanks.

Head-end and rod-end supply and drain valves 26-32 may be interconnected. In particular, head-end and rod-end supply valves 26, 30 may be connected in parallel to an upstream common fluid passageway 60 and connected to downstream chamber passageways 61, 63, respectively. Head-end and rod-end drain valves 28, 32 may be connected in parallel to a common drain passageway 64. Head-end supply and drain valves 26, 28 may be connected in parallel to first chamber fluid passageway 61. Rod-end supply and drain valves 30, 32 may be connected in parallel to common second chamber fluid passageway 63.

Head-end supply valve 26 may be disposed between common fluid passageway 60 and first chamber fluid passageway 61 to regulate a flow of pressurized fluid from source 24 to first chamber 50. Specifically, head-end supply valve 26 may embody a bi-directional force feedback poppet valve having a first valve element 261 and a second valve element 262, such as, for example, the bi-directional force feedback poppet valve described in U.S. patent application Ser. No. 11/454,500 to Pengfei Ma, et al, filed Jun. 16, 2006, the entire disclosure of which is hereby incorporated by reference.

First valve element 261 may have a first port in communication with common fluid passageway 60, and a second port in communication with first chamber fluid passageway 61. First valve element 261 may be slidable in response to a fluid pressure between an open position and a closed position to control fluid flow between source 24 and first chamber 50. Second valve element 262 may be solenoid actuated and slidable to control the movement of first valve element 261 by way of fluid pressure within a head-end control passageway 62*a* and a spring 63*a* connecting first valve element 261 to second valve element 262. Head-end control passageway 62*a* may also bias first valve element 261 towards a closed position. As illustrated, first valve element 261 may be biased toward an open position by a pressure signal taken from fluid passageway 60 and a pressure signal taken from fluid passageway 61. In this manner, when second valve element 262 is moved to an open or fluid passing position, first valve element 261 may also be moved toward an open position. Similarly, when second valve element 262 is moved to a closed position, first valve element 261 may also be moved toward a closed position.

Control passageway 62*a* may be connected to fluid passageway 60 by way of a restrictive orifice 265 and a check valve 264. Similarly, control passageway 62*a* may be connected to fluid passageway 61 by way of a restrictive orifice 267 and a check valve 268. The arrangement of these components may be such that control passageway 62*a* will be in fluid communication with either fluid passageway 60 or fluid passageway 61, depending on which is at a higher pressure after their respective orifice 265, 267. Furthermore, restrictive orifices 265, 267 may be arranged such that an increase in flow through second valve component 262 will result in a reduced pressure in control passageway 62*a*. Conversely, a decrease in flow through second valve component 262 may result in an increase in pressure in control passageway 62*a*.

Head-end drain valve 28 may be disposed between first chamber first passageway 61 and common tank passageway 64 to regulate a flow of pressurized fluid from first chamber 50 to tank 34. Specifically, head-end drain valve 28 may include an infinitely variable, unidirectional two-position spring biased valve mechanism that is solenoid actuated to move between a first position at which fluid is allowed to flow from first chamber 50 to tank 34 and a second position at which fluid is blocked from flowing from first chamber 50. It is contemplated that head-end drain valve 28 may include additional or different valve mechanisms such as, for example, a proportional valve element or any other valve mechanism known in the art. It is also contemplated that head-end drain valve 28 may alternatively be hydraulically actuated, mechanically actuated, pneumatically actuated, or actuated in any other suitable manner.

Rod-end supply valve 30 may be disposed between common fluid passageway 60 and second chamber fluid passageway 63 to regulate a flow of pressurized fluid from source 24 to second chamber 52. Specifically, rod-end supply valve 30 may also embody a bi-directional force feedback poppet valve having a first valve element 301 and a second valve element 302. First valve element 301 may have a first port in communication with common fluid passageway 60, and a second port in communication with second chamber fluid passageway 63. First valve element 301 may be slidable in response to a fluid pressure between an open position and a closed position to control fluid flow between source 24 and second chamber 52. Second valve element 302 may be solenoid actuated and slidable to control the movement of first valve element 301 by fluid pressure within a rod-end control passageway 62*b* and a spring connecting first valve element 301 to second valve element 302. Rod-end control passageway 62*b* may also bias first and second valve elements 301, 302 towards closed positions. As illustrated, first valve element 301 may be biased toward an open position by a pressure signal taken from fluid passageway 60 and a pressure signal taken from fluid passageway 63. In this manner, when second valve element 302 is moved to an open or fluid passing position, first valve element 301 may also be moved toward an open position. When second valve element 302 is moved to a closed position, first valve element 301 may also be moved toward a closed position.

Control passageway 62*b* may be connected to fluid passageway 60 by way of a restrictive orifice 305 and a check valve 304. Similarly, control passageway 62*b* may be connected to fluid passageway 63 by way of a restrictive orifice 307 and a check valve 308. The arrangement of these components may be such that control passageway 62*b* will be in fluid communication with either fluid passageway 60 or fluid passageway 63, depending on which is at a higher pressure after their respective orifice 305, 307. Furthermore, restrictive orifices 305, 307 may be arranged such that an increase in flow through second valve component 302 will result in a reduced pressure in control passageway 62*b*. Conversely, a decrease in flow through second valve component 302 may result in an increase in pressure in control passageway 62*b*.

Rod-end drain valve 32 may be disposed between second chamber fluid passageway 63 and common drain passageway 64 and configured to regulate a flow of pressurized fluid from second chamber 52 to tank 34. Specifically, rod-end drain valve 32 may include an infinitely variable unidirectional two-position spring biased valve mechanism that is solenoid actuated to move between a first position at which fluid is allowed to flow from second chamber 52 to tank 34 and a second position at which fluid is blocked from flowing from second chamber 52. It is contemplated that rod-end drain valve 32 may include additional or different valve mechanisms such as, for example, a proportional valve element or any other valve mechanism known in the art. It is also contemplated that rod-end drain valve 32 may alternately be hydraulically actuated, mechanically actuated, pneumatically actuated, or actuated in any other suitable manner.

Shuttle valve 74 may be disposed between downstream head-end and rod-end fluid passageways 62*a*, 62*b*. Shuttle valve 74 may fluidly connect the one of head-end and rod-end fluid passageways 62*a*, 62*b* having a lower fluid pressure to proportional pressure compensating valve 36 in response to a higher fluid pressure from either head-end or rod-end fluid passageways 62*a*, 62*b*. In this manner, shuttle valve 74 may resolve pressure signals from head-end and rod-end fluid passageways 62*a*, 62*b* to allow the lower pressure of the two to affect movement of proportional pressure compensating valve 36. Hydraulic system 22 may also include a check valve 76 disposed between proportional pressure compensating valve 36 and upstream fluid passageway 60.

Proportional pressure compensating valve 36 may be a hydro-mechanically actuated proportional control valve disposed between source 24 and upstream common fluid passageway 60 to control a pressure of the fluid supplied to upstream common fluid passageway 60. Specifically, proportional pressure compensating valve 36 may include a valve element that is spring and hydraulically biased toward a flow passing position and movable by hydraulic pressure toward a flow blocking position. In one embodiment, proportional pressure compensating valve 36 may be movable toward the flow blocking position by a pressure of fluid directed from a point between proportional pressure compensating valve 36 and upstream common fluid passageway 60 via a fluid passageway 78. A restrictive orifice 80 may be disposed within fluid passageway 78 to minimize pressure and/or flow oscillations within fluid passageway 78. A check valve 76 may be located between proportional pressure compensating valve 36 and upstream common fluid passageway 60 to ensure unidirectional flow of fluid from source 24 to hydraulic actuator 16.

Proportional pressure compensating valve 36 may be movable toward the flow passing position by a fluid directed from shuttle valve 74 via a fluid passageway 82. A restrictive orifice 84 may be disposed within fluid passageway 82 to minimize pressure and/or flow oscillations within fluid passageway 82. It is contemplated that the valve element of proportional pressure compensating valve 36 may alternatively be spring biased toward a flow blocking position, that the fluid from passageway 82 may alternatively bias the valve element toward the flow passing position, and/or that the fluid from passageway 78 may alternatively move the valve element toward the flow blocking position. It is also contemplated that proportional pressure compensating valve 36 may alternatively be located downstream of head-end and rod-end supply valves 26, 30 or in any other suitable location. It is also contemplated that restrictive orifices 80 and 84 may be omitted, if desired.

One or more pressure relief valves may be situated to minimize pressure spikes within hydraulic system 22. For example, a head-end pressure relief valve 38 may be fluidly connected to first chamber fluid passageway 61 between first chamber 50 and head-end supply and drain valves 26, 28. Head-end pressure relief valve 38 may have a valve element spring biased toward a valve closing position and movable to a valve opening position in response to a pressure within first chamber fluid passageway 61 being above a predetermined pressure. In this manner, head-end pressure relief valve 38 may reduce a pressure spike within hydraulic system 22 caused by external forces acting on work implement 14 and piston 54 by allowing fluid from first chamber 50 to drain to tank 34. A rod-end pressure relief valve 42 may be fluidly connected to second chamber fluid passageway 63 between second chamber 52 and rod-end supply and drain valves 30, 32. Rod-end pressure relief valve 42 may have a valve element spring biased toward a valve closing position and movable to a valve opening position in response to a pressure within second chamber fluid passageway 63 being above a predetermined pressure. In this manner, rod-end pressure relief valve 42 may be configured to reduce a pressure spike within hydraulic system 22 caused by external forces acting on work implement 14 and piston 54 by allowing fluid from second chamber 52 to drain to tank 34.

One or more makeup valves may be situated to replenish fluid lost from hydraulic system 22. For example, a head-end makeup valve 40 may be fluidly connected to first chamber fluid passageway 61 between first chamber 50 and head-end supply and drain valves 26, 28. Head-end makeup valve 40 may have a valve element configured to allow fluid from tank 34 into first chamber fluid passageway 61 in response to a fluid pressure within first chamber fluid passageway 61 being below a pressure of the fluid within tank 34. In this manner, head-end makeup valve 40 may be configured to reduce a drop in pressure within hydraulic system 22 caused by external forces acting on work implement 14 and piston 54 by allowing fluid from tank 34 to fill first chamber 50. A rod-end makeup valve 44 may be fluidly connected to second chamber fluid passageway 63 between second chamber 52 and rod-end supply and drain valves 30, 32. Rod-end makeup valve 44 may have a valve element configured to allow fluid from tank 34 into second chamber fluid passageway 63 in response to a fluid pressure within second chamber fluid passageway 63 being below a pressure of the fluid within tank 34. In this manner, rod-end makeup valve 44 may be configured to reduce a drop in pressure within hydraulic system 22 caused by external forces acting on work implement 14 and piston 54 by allowing fluid from tank 34 to fill second chamber 52.

INDUSTRIAL APPLICABILITY

The disclosed hydraulic system may be applicable to any machine that includes a fluid actuator, where compensation for pressure fluctuations and/or inconsistent flows of fluid supplied to the actuator is desired. The disclosed hydraulic system may provide high response pressure regulation that protects the components of the hydraulic system and provides consistent actuator performance in a low cost simple configuration. The operation of hydraulic system 22 will now be explained.

Hydraulic cylinder 16 may be movable by fluid pressure in response to an operator input. Fluid may be pressurized by source 24 and directed to head-end and rod-end supply valves 26 and 30. In response to an operator input to either extend or retract piston assembly 48 relative to tube 46, one of head-end and rod-end supply valves 26 and 30 may move to the open position to direct the pressurized fluid to the appropriate one of first and second chambers 50, 52. Substantially simultaneously, a corresponding one of head-end and rod-end drain valves 28, 32 may move to the open position to direct fluid from the appropriate one of the first and second chambers 50, 52 to tank 34 to create a pressure differential across piston 54 that causes piston assembly 48 to move. For example, if an extension of hydraulic cylinder 16 is requested, head-end supply valve 26 may move to the open position to direct pressurized fluid from source 24 to first chamber 50. Substantially simultaneous to the directing of pressurized fluid to first chamber 50, rod-end drain valve 32 may move to the open position to allow fluid from second chamber 52 to drain to tank 34. If a refraction of hydraulic cylinder 16 is requested, rod-end supply valve 30 may move to the open position to direct pressurized fluid from source 24 to second chamber 52. Substantially simultaneous to the directing of pressurized fluid to second chamber 52, head-end drain valve 28 may move to the open position to allow fluid from first chamber 50 to drain to tank 34.

Because multiple actuators may be fluidly connected to source 24, the operation of one of the actuators may affect the pressure and/or flow of fluid directed to hydraulic cylinder 16. If left unregulated, these affects could result in inconsistent and/or unexpected motion of hydraulic cylinder 16 and work implement 14, and could possibly result in shortened component life of hydraulic system 22. Proportional pressure compensating valve 36 may account for these affects by proportionally moving valve element 36*a* between the flow passing and flow blocking positions in response to fluid pressures within hydraulic system 22 to provide a substantially constant predetermined pressure drop across all supply valves of hydraulic system 22. To illustrate this operation an example with respect to head-end supply valve 26 is given below.

Source 24 may pressurize fluid and communicate the pressurized fluid to first and second elements 261, 262 of head-end supply valve 26 via common fluid passageway 60. To allow fluid to flow through head-end supply valve 26, second valve element 262 may be moved via solenoid to fluidly connect head-end control passageway 62*a* with first chamber fluid passageway 61. This may result in a pressure decrease in head-end control chamber 62*a* as it drains to first chamber fluid passageway 61. This lowered pressure of head-end control chamber 62*a* may decrease the bias exerted on first element 261 to bias first element 261 toward a closed position due to an increase in the pressure differential between fluid passageway 60 and control passageway 62*a*. This pressure differential may result, at least in part, due to fluid flow through restrictive orifice 265. This increased pressure differential may result in first valve element 261 moving toward a flow passing position to equalize the hydraulic and spring forces. As second valve element 262 opens to decrease the pressure of head-end control chamber 62*a*, it may also simultaneously bias valve element 261 towards the closed position by way of a spring. First valve element 261 may reach a new equilibrium state where the valve closing forces, consisting of the force applied by second valve element 262 through the coupled spring and the pressure of control passageway 62*a*, may equal the valve opening force, consisting of the pressure of first port 261.

To stop the flow of fluid through head-end supply valve 26, second valve element 262 may be moved to a closed position to stop the fluid flow from control passageway 62*a* to first chamber fluid passageway 62*a*. The fluid pressure within control passageway 62*a* may thus increase, approaching the pressure of fluid passageway 60. As the pressure of control passageway 62*a* increases, the pressure differential between first port 263 and head-end control passageway 62*a* may decrease. This decreased pressure differential may result in first valve element 261 moving toward a flow blocking position to reach a new equilibrium condition where the valve closing forces, consisting of the force applied by second valve element 262 through the coupled spring and the pressure of control passageway 62*a*, may equal the valve opening force, consisting of the pressure of first port 261. The operation of rod-end supply valve 30 may be substantially the same.

As one of head-end and rod-end supply valves 26, 30 is moved to the flow passing position, pressure within control passageway 62*a* or 62*b* associated with the flow passing valve may be lower than the pressure within control passageway 62*a* or 62*b* associated with the flow blocking valve. As a result, shuttle valve 74 may be biased by the higher pressure toward the flow passing valve, thereby communicating the lower pressure from the flow passing valve to proportional pressure compensating valve 36. This lower pressure may then act together with the force of the proportional pressure compensating valve spring against the pressure from fluid passageway 78. The resultant force may then either move the valve element of proportional pressure compensating valve 36 toward the flow blocking or flow passing positions. As the pressure from source 24 drops, proportional pressure compensating valve 36 may move toward the flow passing position and thereby maintain the pressure within upstream common fluid passageway 60. Similarly, as the pressure from source 24 increases, proportional pressure compensating valve 36 may move toward the flow blocking position to thereby maintain the pressure within upstream common fluid passageway 60. In this manner, proportional pressure compensating valve 36 may regulate the fluid pressure within hydraulic system 22.

Because proportional pressure compensating valve 36 may be hydro-mechanically actuated, pressure fluctuations within hydraulic system 22 may be quickly accommodated before they can significantly influence motion of hydraulic cylinder 16 or life of components within hydraulic system 22. In addition, because proportional pressure compensating valve 36 may be hydro-mechanically actuated rather than electronically controlled, the cost of hydraulic system 22 may be minimized. Further, because proportional pressure compensating valve 36 may utilize the pressure of head-end or rod-end control passageway 62*a* or 62*b* a consistent pressure differential may be obtained since there may be few leak paths between common fluid passageway 60 and head-end and rod-end control passageways 62*a* and 62*b*.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system, comprising:
a source of pressurized fluid;
a fluid actuator having a first chamber;
a first valve configured to selectively fluidly communicate the source with the first chamber, the first valve having:
a first element movable between a flow passing position, at which fluid from the source flows to the first chamber, and a flow blocking position, at which fluid from the source is blocked from the first chamber; and
a second element configured to selectively drain a first control passageway associated with the first element to cause the first element to move; and
a proportional pressure compensating valve configured to control a pressure of a fluid directed between the source and the first valve dependent upon the pressure of the first control passageway.

2. The hydraulic system of claim 1, wherein:
the fluid actuator further includes a second chamber; and
the hydraulic system further includes:
a second valve configured to selectively fluidly communicate the source with the second chamber, the second valve having:
a third element movable between a flow passing position and a flow blocking position; and
a fourth element configured to selectively drain a second control passageway associated with the third element to cause the third element to move.

3. The hydraulic system of claim 2, further including a first fluid passageway disposed between the source and the first and second valves, wherein the first and second valves are connected to the first fluid passageway in parallel and the proportional pressure compensating valve is disposed between the source and the first fluid passageway.

4. The hydraulic system of claim 3, further including a second fluid passageway, wherein the proportional pressure compensating valve includes a valve element movable between a flow passing position and a flow blocking position, and the second fluid passageway is configured to communicate fluid between the proportional pressure compensating valve and the first fluid passageway to bias the valve element toward the flow blocking position.

5. The hydraulic system of claim 4, further including a shuttle valve disposed between the first control passageway and the second control passageway, the shuttle valve being movable between a first position at which pressurized fluid from the first control passageway passes to a third fluid passageway, and a second position at which pressurized fluid passes from the second control passageway to the third fluid passageway.

6. The hydraulic system of claim 5, wherein pressurized fluid from the third fluid passageway is directed to the proportional pressure compensating valve to bias the valve element toward the flow passing position.

7. The hydraulic system of claim 6, wherein the proportional pressure compensating valve includes a spring configured to bias the valve element toward one of the flow passing and flow blocking positions.

8. The hydraulic system of claim 3, wherein the first control passageway is in selective fluid communication with the first fluid passageway by way of a first restrictive orifice.

9. The hydraulic system of claim 8, wherein the first control passageway is in selective fluid communication with the first chamber by way of a second restrictive orifice.

10. The hydraulic system of claim 9, further including a first check valve disposed between the first control passageway and the first fluid passageway and a second check valve disposed between the first control passageway and the first chamber.

11. A method of operating a hydraulic system, comprising:
pressurizing a fluid;
directing the pressurized fluid to a first chamber of an actuator via a first valve;
directing the pressurized fluid to a second chamber of the actuator via a second valve;
selectively operating at least one of the first and second valves to move the actuator; and
moving a proportional pressure compensating valve element in response to pressures at a control passageway of one of the first and second valves to maintain a pressure differential across the one of the first and second valves within a predetermined range of a desired pressure differential.

12. The method of claim 11, further including:
draining the pressurized fluid from the first chamber via a third valve;
draining the pressurized fluid from the second chamber via a fourth valve; and
selectively operating one of the third and fourth valves in conjunction with one of the first and second valves to move the actuator.

13. The method of claim 11, wherein directing pressurized fluid to the first and second chambers includes directing the pressurized fluid through a first fluid passageway disposed upstream of the first and second valves, the first and second valves are connected to the first fluid passageway in parallel, and the proportional pressure compensating valve element is disposed between the first fluid passageway and a source of the pressurized fluid.

14. The method of claim 13, further including directing pressurized fluid from the actuator to the first fluid passageway via the first and second valves when a pressure within one of the first and second chambers of the actuator exceeds a pressure within the first fluid passageway.

15. The method of claim 13, wherein moving the proportional pressure compensating valve element includes directing pressurized fluid from between the proportional pressure compensating valve element and the first fluid passageway to the proportional pressure compensating valve element to bias the proportional pressure compensating valve element toward a flow blocking position.

16. The method of claim 15, further including selectively communicating pressurized fluid from one of the first and second valves to the proportional pressure compensating valve element to bias the proportional pressure compensating valve element toward a flow passing position.

17. The method of claim 16, wherein selectively communicating pressurized fluid from one of the second and fourth valves to the proportional pressure compensating valve element includes directing the pressurized fluid from a shuttle valve member disposed in a fluid passageway connected between the second and fourth valves to the proportional pressure compensating valve.

18. A machine, comprising:

a work implement;

a source of pressurized fluid;

a fluid actuator having a first chamber and a second chamber;

a first valve configured to selectively fluidly communicate the source with the first chamber, the first valve having:

a first element movable between a fluid passing and a flow blocking position; and a second element configured to selectively drain a first control passageway of the first element to cause the first element to move; and a second valve configured to selectively fluidly communicate the source with the second chamber, the second valve having:

a third element movable between a fluid passing and a flow blocking position; and a fourth element configured to selectively drain a second control passageway of the third element to cause the third element to move; and a proportional pressure compensating valve configured to control a pressure of a fluid directed between the source and the first and second valves dependent upon the pressure of one of the first control passageway and the second control passageway.

19. The machine of claim 18, further including a first fluid passageway disposed upstream of the first and second valves, wherein the first and second valves are connected to the first fluid passageway in parallel and the proportional pressure compensating valve is disposed between the first fluid passageway and the source.

20. The machine of claim 19, further including a second fluid passageway, wherein the proportional pressure compensating valve includes a valve element movable between a flow passing position and a flow blocking position, and the second fluid passageway is configured to direct fluid from between the proportional pressure compensating valve and the first fluid passageway to the proportional pressure compensating valve to bias the valve element toward one of the flow passing position and the flow blocking position.

* * * * *